US007547072B1

(12) United States Patent
Delmestri

(10) Patent No.: US 7,547,072 B1
(45) Date of Patent: Jun. 16, 2009

(54) CONCEALABLE LEG SUPPORT FOR A RECLINER

(76) Inventor: Fabio G. Delmestri, 829 Blair St., Thomasville, NC (US) 27360

( * ) Notice: Subject to any disclaimer, the term of this patent is extended or adjusted under 35 U.S.C. 154(b) by 210 days.

(21) Appl. No.: 11/511,811

(22) Filed: Aug. 29, 2006

(51) Int. Cl.
*A47C 7/50* (2006.01)
*A47C 20/00* (2006.01)

(52) U.S. Cl. ..... 297/423.21

(58) Field of Classification Search ..... 297/423.2, 297/423.21, 69
See application file for complete search history.

(56) References Cited

U.S. PATENT DOCUMENTS

| | | | | | |
|---|---|---|---|---|---|
| 426,602 | A * | 4/1890 | Muhl | 297/68 |
| 2,326,910 | A * | 8/1943 | Young | 297/69 |
| 2,526,623 | A * | 10/1950 | Maurer | 297/88 |
| 2,604,146 | A * | 7/1952 | Martin | 297/423.22 |
| 2,901,025 | A * | 8/1959 | Malitte | 297/423.24 |
| 2,903,045 | A * | 9/1959 | Viall | 297/69 |
| 3,295,885 | A * | 1/1967 | Barksdale | 297/84 |
| 4,860,393 | A * | 8/1989 | Schefthaler | 5/21 |
| 5,277,477 | A * | 1/1994 | Sharff et al. | 297/423.21 |
| 5,312,161 | A * | 5/1994 | Mars | 297/423.2 |
| 6,604,791 | B1 * | 8/2003 | Chen | 297/330 |
| 6,648,418 | B2 * | 11/2003 | Bergeron et al. | 297/423.43 |
| 6,692,078 | B2 * | 2/2004 | Pham et al. | 297/423.2 |
| 6,843,531 | B2 * | 1/2005 | Williams | 297/337 |
| 6,948,777 | B2 * | 9/2005 | Marshall et al. | 297/423.4 |
| 7,083,235 | B2 * | 8/2006 | Grimm et al. | 297/423.21 |

* cited by examiner

*Primary Examiner*—David Dunn
*Assistant Examiner*—Tania Abraham

(57) ABSTRACT

A light weight, durable recliner mechanism is provided for various chairs, sofas and other furniture for the manual extension and retraction of a leg support. The mechanism includes an axle operated by an extended handle. A pair of arms having V-shaped pivotable sections extend the leg support forwardly of the chair as desired. The sides of the chair act as guide supports and each define a slot for receiving a moveable slot guide which is part of the recliner mechanism. At the terminal end of each slot and communicating therewith is a locking channel to prevent the recliner mechanism from inadvertently retracting if contacted such as by being bumped or kicked. The recliner mechanism will support heavy loads without damage due in part to it remaining grounded during use.

11 Claims, 8 Drawing Sheets

CONCEALABLE LEG SUPPORT FOR A RECLINER

FIELD OF THE INVENTION

The invention herein pertains to furniture and in particular pertains to a recliner mechanism for operation of a leg support or rest.

DESCRIPTION OF THE PRIOR ART AND OBJECTIVES OF THE INVENTION

Mechanical recliner assemblies have long been used in various furniture to allow a chair to repose as desired by the user. Oftentimes the leg rest extends forwardly of the chair cantilevered to a horizontal or other angled posture. The back is also usually tilted by such mechanisms which are generally formed from heavy metal parts to provide the support and durability needed. This added weight increases the manufacturing and shipping costs and the concerns of consumers due to the difficulty in moving the furniture in the home.

In order to overcome the problems and disadvantages of conventional recliners mechanisms and to lower the costs of assembly and manufacturing, the present invention was conceived and one of its objectives is to provide a retractable leg support for furniture which is light in weight, easy to operate and assemble.

It is still another objective of the present invention to provide a recliner mechanism in the form of a leg support which is always grounded and includes a frame supported on the floor by wheels.

It is yet another objective of the present invention to provide a recliner mechanism which is affixed and concealed within the furniture in its retracted mode for aesthetic purposes.

It is also another objective of the present invention to provide a recliner mechanism and method having a frame moveable by a handle affixed to the side of the furniture which rotates an axle attached thereto.

It is still a further objective of the present invention to provide a recliner mechanism in the form of a leg support which is grounded for supporting heavy loads up to 350 pounds or more.

Various other objectives and advantages of the present invention will become apparent to those skilled in the art as a more detailed description is set forth below.

SUMMARY OF THE INVENTION

The aforesaid and other objectives are realized by providing a concealed recliner mechanism, particularly a leg support which is extendable while remaining grounded. Furniture having the mechanism is useful for various locations, such as in physicians' waiting rooms. The mechanism is operated by a handle affixed to the outside of the furniture and includes a tubular frame with legs. Beneath the seat of the furniture an internal axle is affixed to a pair of arms formed from V-sections which extend and retract as desired. The mechanism rolls along the floor for support on wheels attached to the legs to allow the support of heavy loads up to 350 pounds or more (159 kg) without distortion or breaking. When retracted the mechanism creates an aesthetic appearance for the furniture.

DETAILED DESCRIPTION OF THE PREFERRED EMBODIMENT AND OPERATION OF THE INVENTION

Figure 1:
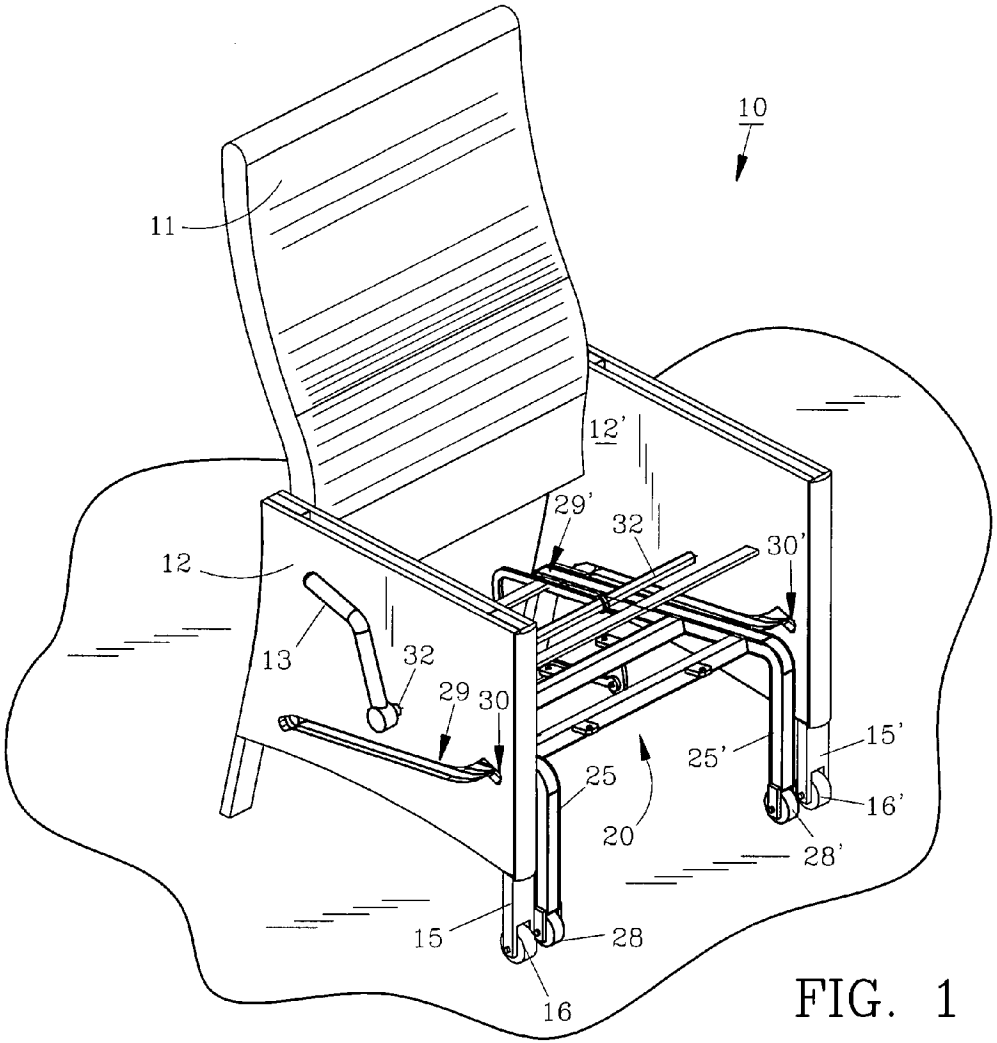
FIG. 1 shows a schematic representation of a reclining chair with the recliner mechanism installed and shown in a retracted mode.
Figure 2:
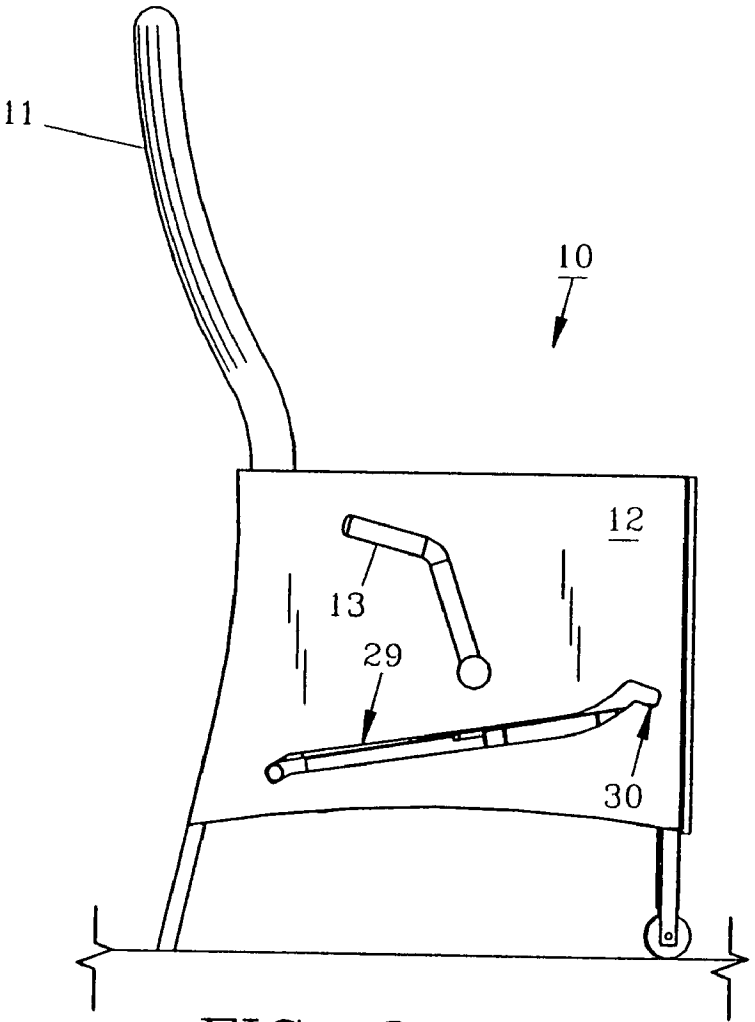
FIG. 2 demonstrates a side elevational view of the chair as seen in FIG. 1.

For a better understanding of the invention and its operation, turning now to the drawings, in FIG. 1 a schematic view of preferred chair 10 is shown with back 11, sides 12, 12' and preferred recliner mechanism 20 in a retracted posture. Chair 10 is seen without conventional seat, back, or stool cushions or coverings for clarity. As would be understood various chairs, sofas or other furniture could employ recliner mechanism 20. Tilting chair back mechanisms are also conventional in the art but are not shown or used herein for brevity purposes. Chair 10 is only shown schematically without upholstery, padding or cushions to better illustrate recliner mechanism 20 and its method of operation.

To better illustrate its operation or method, various views of recliner mechanism 20 in a retracted position are shown in FIGS. 2-5 with handle 13 positioned in an upright position. FIGS. 6-9 show recliner mechanism 20 in various views in an extended posture.

Figure 6:
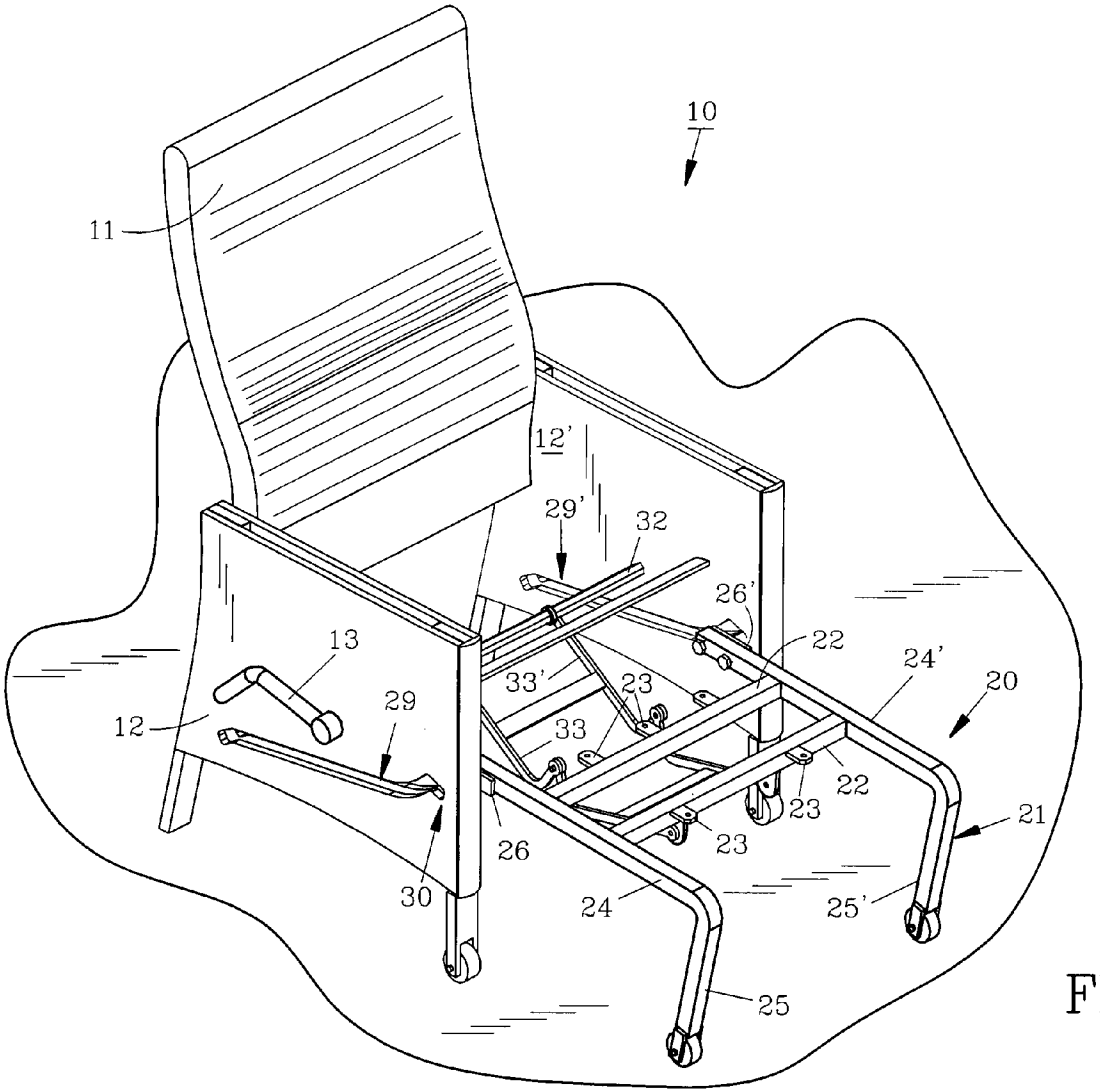
FIG. 6 pictures the chair seen in FIG. 1 but with the recliner mechanism extended.
Figure 7:
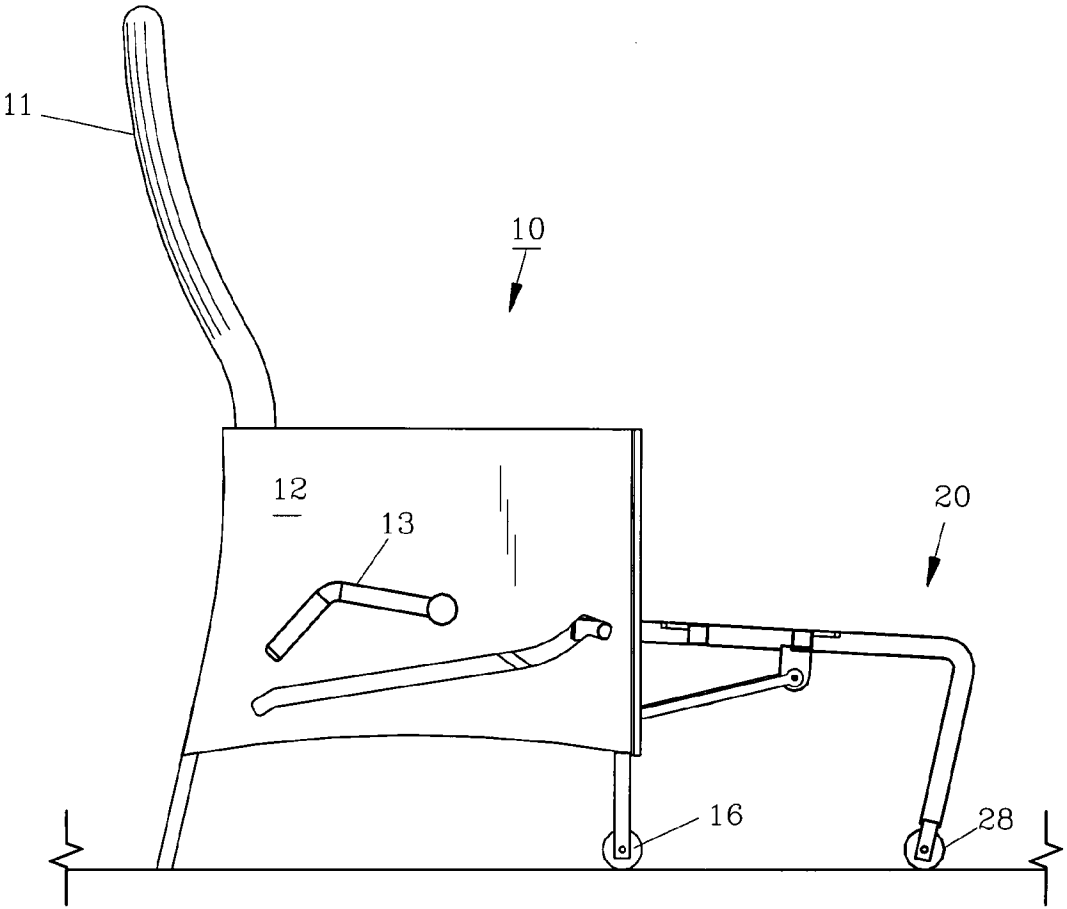
FIG. 7 shows a side elevational view of the chair as seen in FIG. 6.

Recliner mechanism 20 as seen in FIG. 6 includes metal tubular frame 21 preferably formed from aluminum but may be formed from other materials and has been arc welded or otherwise joined. A pair of cross members 22 are attached also such as by welding. Cross members 22 include cushion attachments 23 in the form of tabs for affixing a stool cushion or cushion base. Frame 21 includes left side frame member 24 and right side frame member 24' having legs 25, 25' respectively. At the terminal ends of left and right side frame members 24, 24' are planar shaped slot guides 26, 26' respectively affixed thereto such as by bolting, seen also in FIGS. 5 and 9. Slot guide 26 includes slot roller 27 whereas slot guide 26' includes slot roller 27' as seen for example in FIGS. 4 and 8. Slot guide rollers 27, 27' consist of cylindrical nylon rollers which are sized to roll or slide along slots 29, 29' which act as guide supports for slot guides 26, 26' respectively as shown in FIGS. 1 and 6 during extension and retraction of recliner mechanism 20.

In FIGS. 1-5, recliner mechanism 20 is in a retracted mode between chair guide supports or sides 12, 12'. In FIG. 6, recliner mechanism 20 is extended from the front of chair 10 with slot rollers 27, 27' positioned within locking channels 30, 30' formed in sides 12, 12' which are at the terminal end of slots 29, 29' respectively and are angled downwardly from the horizon approximately thirty degrees (30°). Locking channels 30, 30' prevent inadvertent retraction of recliner mechanism 20 such as may occur if legs 25, 25' are bumped or kicked while frame 21 is extended. Locking channels 30, 30' communicate with slots. 29, 29' respectively to allow slot guide rollers 27, 27' to easily move therealong. Once slot guide rollers 27, 27' engage channels 30, 30' and recliner mechanism 20 is fully extended, handle 13 is in a downward position as shown in FIGS. 6-9. As understood, rod-like handle 13 is preferably positioned on the left side of chair 10 as shown in FIG. 1 but could also be placed on the right side of chair 10 if desired.

Figure 3:
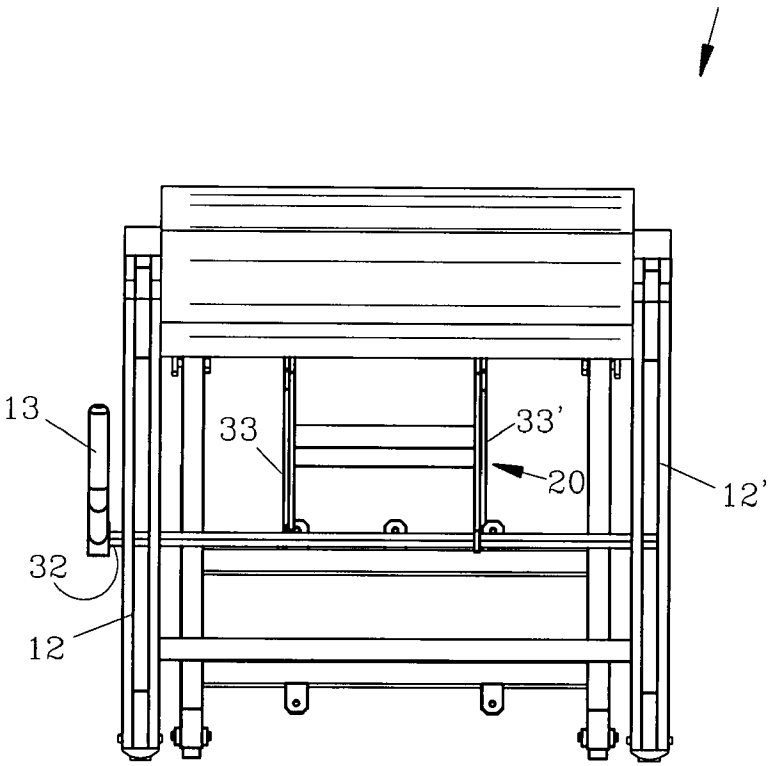
FIG. 3 features a top plan view of the chair as shown in FIG. 1.
Figure 4:
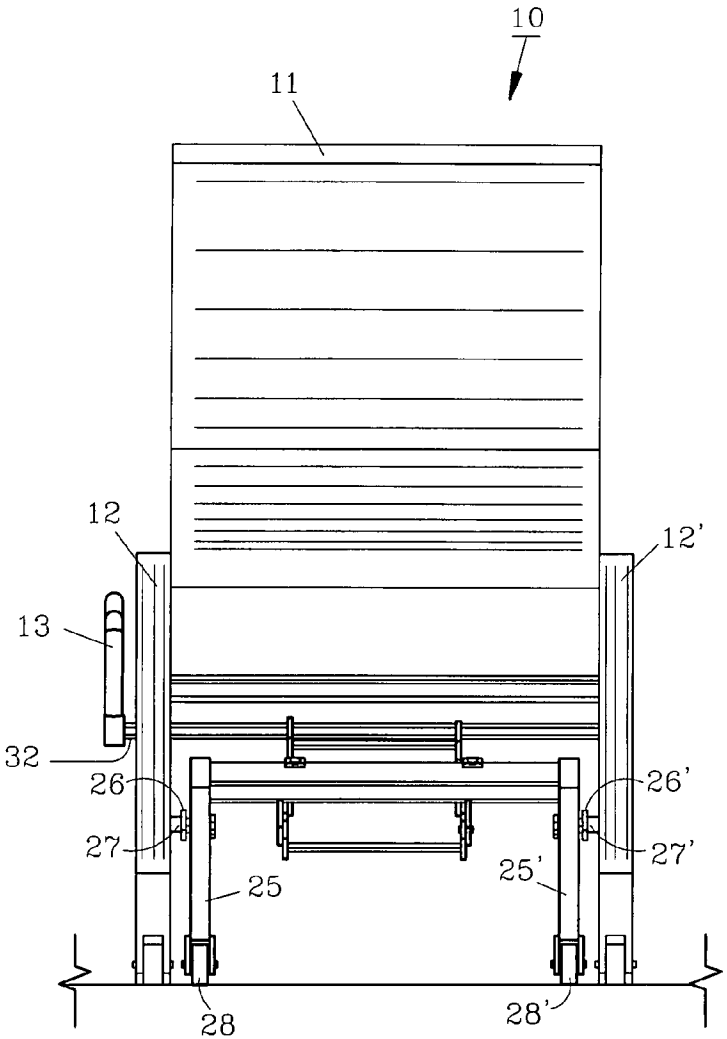
FIG. 4 depicts a front elevational view of the chair shown as in FIG. 1.
Figure 5:
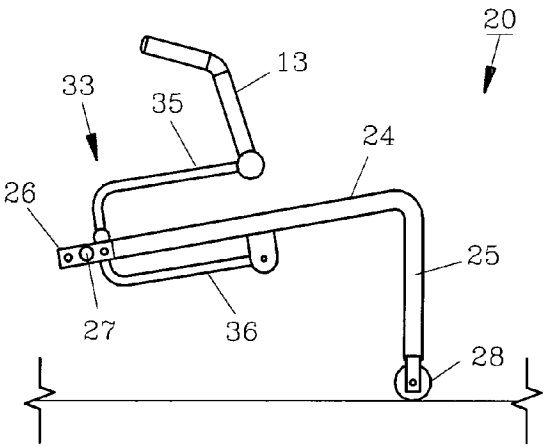
FIG. 5 shows a side elevational view of the retracted recliner mechanism as removed from the chair.
Figure 9:
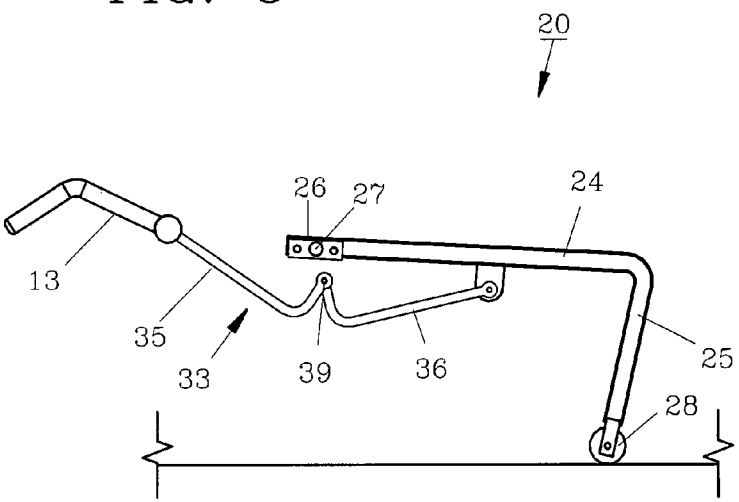
FIG. 9 depicts a side elevational view of the recliner mechanism removed from the chair in an extended mode.
Figure 8:
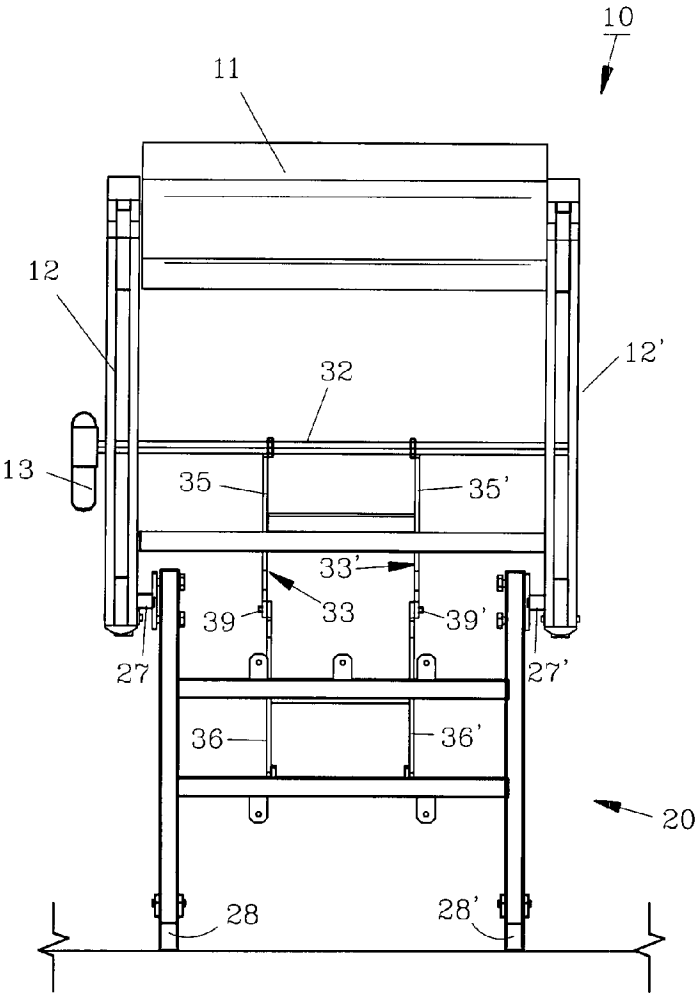
FIG. 8 demonstrates a top plan view of the chair as shown in FIG. 6.

As shown in FIG. 8, handle 13 is rigidly affixed to axle 32 which is rotatably supported on the inside of chair sides 12, 12'. Handle 13 is manually urged rearward, rotating axle 32 which in turn rotates arms 33, 33' as seen in FIGS. 3, 8 and 9 which are connected thereto causing recliner mechanism 20 to roll forward of chair 10. Arms 33, 33' include a pair of V-sections 35, 36 and 35', 36' respectively which form "W" shapes for extension stability. V-section 36 is pivotally joined to V-section 35 and V-section 36' is pivotally joined to V-section 35' by bolts 39, 39' respectively as seen in FIGS. 8 and 9.

In order to facilitate movement of chair 10 front legs 15, 15' include wheels 16, 16' respectively and side frame members 24, 24' have wheels 28, 28' affixed thereto.

The illustrations and examples provided herein are for explanatory purposes and are not intended to limit the scope of the appended claims.

I claim:

1. A concealable leg support for a recliner comprising a frame, said frame comprising a frame member, a leg, said leg rigidly attached to said frame member, a slot guide, said slot guide affixed to said frame member for engaging a slot, a cross member, said cross member attached to said frame member, an arm, said arm comprising a pair of V-sections, said pair of V-sections pivotally joined to each other, an axle, one of said pair of V-sections attached to said axle and the other of said pair of V-sections attached to said cross member whereby rotating said axle will extend said frame.

2. The concealable leg support for a recliner of claim 1 further comprising a wheel, said wheel attached to said leg.

3. The concealable leg support for a recliner of claim 1 wherein said frame is formed from a tubular metal.

4. The concealable leg support for a recliner of claim 1 wherein said pair of V-sections form a W-shape when said frame is extended.

5. A concealable leg support for a recliner having a pair of opposing sides comprising: a frame, said frame comprising a frame member, a leg, said leg attached to said frame member, a slot guide, said slot guide attached to said frame member, a cross member, said cross member attached to said frame member, an axle, said axle rotatably positioned between the opposing sides, an arm, said arm comprising a pair of arm sections, said pair of arm sections pivotally joined to each other, said arm affixed to said axle and to said frame member, a handle, said handle joined to said axle whereby turning said handle will rotate said axle and extend said frame.

6. The concealable leg support for a recliner of claim 5 further comprising a wheel, said wheel affixed to said leg.

7. The concealable leg support for a recliner of claim 5 wherein one of said pair of opposing sides defines a slot, said slot guide positioned in said slot.

8. The concealable leg support for a recliner of claim 7 wherein said opposing side further defines a locking channel, said locking channel communicating with said slot.

9. The concealable leg support for a recliner of claim 8 wherein said locking channel is angled sharply from said slot.

10. The concealable leg support for a recliner of claim 5 wherein each of said pair of arm sections are V-shaped.

11. The concealable leg support for a recliner of claim 5 wherein said handle is exterior of one of said pair of opposing sides.

* * * * *